US009406207B2

(12) United States Patent
Parsadayan

(10) Patent No.: US 9,406,207 B2
(45) Date of Patent: Aug. 2, 2016

(54) CHAIN DRIVEN GATE AND SECURITY SYSTEM

(71) Applicant: Alex Parsadayan, Foothill Ranch, CA (US)

(72) Inventor: Alex Parsadayan, Foothill Ranch, CA (US)

( * ) Notice: Subject to any disclaimer, the term of this patent is extended or adjusted under 35 U.S.C. 154(b) by 0 days.

(21) Appl. No.: 14/620,767

(22) Filed: Feb. 12, 2015

(65) Prior Publication Data

US 2015/0269817 A1 Sep. 24, 2015

Related U.S. Application Data

(60) Provisional application No. 61/969,659, filed on Mar. 24, 2014.

(51) Int. Cl.

| | |
|---|---|
| ***E05F 11/00*** | (2006.01) |
| ***G08B 13/12*** | (2006.01) |
| ***E06B 11/02*** | (2006.01) |
| ***E05F 15/643*** | (2015.01) |
| ***G08B 13/08*** | (2006.01) |

(52) U.S. Cl.

CPC ..... *G08B 13/12* (2013.01); *E05F 15/643* (2015.01); *E06B 11/026* (2013.01); *G08B 13/08* (2013.01); *E05Y 2201/656* (2013.01); *E05Y 2400/502* (2013.01); *E05Y 2800/424* (2013.01)

(58) Field of Classification Search

CPC .... G08B 13/12; G08B 13/122; E06B 11/026; E06B 11/045; E05F 15/643; E05F 15/60; B65G 43/06

USPC ..... 49/352; 340/547

See application file for complete search history.

(56) References Cited

U.S. PATENT DOCUMENTS

| | | | | |
|---|---|---|---|---|
| 3,963,115 | A * | 6/1976 | Teske | B65G 43/02 198/718 |
| 4,657,131 | A | 4/1987 | Brychta et al. | |
| 4,858,383 | A * | 8/1989 | Kendig | E05F 15/72 256/1 |
| 4,858,747 | A | 8/1989 | Eunson | |
| 6,091,217 | A * | 7/2000 | Parsadayan | E05F 15/41 318/283 |
| 6,092,338 | A * | 7/2000 | Crowner | E05F 15/643 49/360 |
| 6,392,537 | B1 | 5/2002 | Tazumi et al. | |
| 6,851,546 | B2 * | 2/2005 | Lodge | G01B 7/046 198/502.1 |
| 7,140,486 | B2 * | 11/2006 | Kim | F16H 7/08 198/502.4 |
| 8,387,777 | B2 * | 3/2013 | Tokhtuev | B65G 43/02 198/502.1 |
| 2008/0229666 | A1 * | 9/2008 | Jones | E05F 15/635 49/334 |
| 2012/0326867 | A1 * | 12/2012 | Parsadayan | G08B 13/1654 340/541 |

FOREIGN PATENT DOCUMENTS

| | | | | |
|---|---|---|---|---|
| CN | 201056871 Y | | 5/2008 | |
| CN | 201056871 Y | * | 5/2008 | E04H 6/18 |
| EP | 0111643 B1 | * | 5/1987 | H01M 2/24 |
| EP | 111643 A2 | | 7/2011 | |

* cited by examiner

*Primary Examiner* — Katherine Mitchell
*Assistant Examiner* — Abe Massad
(74) *Attorney, Agent, or Firm* — Russo & Duckworth, LLP; David G. Duckworth

(57) ABSTRACT

A chain driven gate and security system is provided. The system includes a gate which is opened and closed by a gate operator. The gate operator includes a chain and a motor having a rotatable sprocket for engaging the links of a chain. The gate and security system includes a sensor for detecting whether the chain has been severed, an alarm for producing a visible or audible alert, and a processor connected to the motor, sensor and alarm. The processor activates an alarm in the event that the processor indicates that the gates should be closed, but that the chain has been severed.

2 Claims, 7 Drawing Sheets

CHAIN DRIVEN GATE AND SECURITY SYSTEM

RELATED APPLICATIONS

The present application is a continuation of U.S. Provisional Patent Application Ser. No. 61/969,659 filed on Mar. 24, 2014.

BACKGROUND OF THE INVENTION

The present invention relates to automated gates. More specifically, the present invention relates to a security system for chain driven automated sliding gates.

Automated gates are ubiquitous in present day to society to control access to secure areas. Automated gates are openable and closable upon a predetermined trigger, such as an open command, a close command, or based upon predetermined dates and times. Most commonly, automated gates are used at the entrance to a facility and are used to control pedestrian or vehicular access on and off the location. For example, homes and office facilities may employ an automated gate at their main entrance. All persons and vehicles entering and exiting the facility are directed through the automated gate. Automated gates are also used at interior locations within a facility. For example, automated gates are used within parking garages to provide protection to parked cars.

Automated gates typically include two components, namely the gate and the gate operator. The gate is a physical structure that is moved to block a portal through which persons or vehicles ingress or egress. Most gates used in commercial applications are made of wood or metal, and may or may not include various decorative features. Meanwhile, the gate operator is the machinery that moves the gate from an open condition to a closed condition, or vice versa. Typically, gate operators are electrically powered and include a motor, a drive mechanism, and a processor for selectively activating the gate operator. Typically, the gate operators are chain driven, gear driven or hydraulic driven.

Common gates used for automated gates include the slide gate, the cantilever gate, the swing gate, the vertical lift gate, the vertical pivot lift gate, the bi-folding gate, and the barrier arm gate. The present application is believed to have application to any of these gates where the gate operator employs a length of chain to open and close the gate.

The most common type of automated gate is the slide gate. The slide gate is mounted parallel to the inside of a wall, fence or barrier and slides horizontally back and forth across a portal or opening through which persons or vehicles will pass. The slide gate includes rollers to support it. These rollers typically roll upon a metal track that has been installed along the ground across the gate opening. For this reason, slide gates are sometimes referred to as "rolling gates" or "track gates".

Typically, the gate operator includes a chain drive for moving the gate back and forth. The chain drive includes a length of chain which affixes to the gate. Moreover, the chain drive includes a motor having a sprocket gear wherein the teeth of the gear mesh with the holes in the links of the chain. Activation of the motor, and in turn rotation of the gear, causes the chain to pull the slide gate in one direction or another. Chain drive mechanisms typically include a processor and sensors for determining whether the gate has opened or closed completely so as to timely deactivate the motor.

Advantageously, the gate is effectively locked in place if the motor has been deactivated and rotation of the sprocket gear has been rotationally locked so to prevent pulling of the chain or movement of the gate.

Unfortunately, thieves and trespassers have discovered that the security provided by the gate can be easily overcome by simply cutting the chain. Once the chain has been cut, it will fall, thereby allowing the chain to disengage from the motor's sprocket and enable one to simply manually slide the gate from a closed condition to an open condition. Trespassers can then simply walk or drive through the previously closed portal.

Accordingly, there is a need for an improved security system for chain driven gates.

In addition, it would be advantageous to provide a security system for a chain driven gate which activated an alarm in the event that the chain had been cut.

Moreover, it would be advantageous to provide a security system for a chain driven gate that did not require substantial additional hardware and software.

SUMMARY OF THE INVENTION

The present invention addresses the aforementioned disadvantages by providing an improved chain driven gate and security system. The system includes a gate for selectively blocking an opening. The gate may be constructed in any form as can be determined by one skilled in the art so as to have a size sufficiently large to obstruct passage of persons or vehicles through the intended passageway. Typically, it is believed that the gate will be relatively thin and rectangular so as to have a top, a bottom, and opposing side edges. Preferably, the gate includes wheels for allowing the gate to easily slide upon a track within a groove, or includes another construction for reducing friction as the gate moves. Furthermore, the gate may be made of any material commonly used for constructing a gate including iron, chain link, wood slats, etc.

The chain driven gate and security system also includes a gate operator for opening and closing the gate. The gate operator includes a length of chain made up of individual links. The chain has first and second ends affixed to the gate. Preferably, but not necessarily, the first end of the chain is affixed towards a left edge of the gate and the second end of the chain is affixed toward the right edge of the gate. The gate operator includes a motor having a toothed sprocket for receiving the individual links of the chain such that activation of the motor and rotation of the sprocket causes the chain to be pulled in one direction or another so as to open or close the gate.

The gate and security system includes a sensor for detecting whether the chain has been severed. In a preferred embodiment, the sensor includes a magnet affixed to a predetermined location upon the chain. Furthermore, the sensor includes a magnetic field detector for determining whether the magnet is adjacent to it. To this end, the magnetic field detector may be simply a simple magnetically activated switch which is activated upon a magnet being nearby. The magnet is affixed to the chain and positioned so as to be adjacent to the magnetic field detector when the gate is in a closed condition. Preferably, the magnet affixed to the chain performs two functions. First, the magnet and magnetic field detector can be utilized as a signal that the gate has traveled from an open condition to a closed condition so as to trigger deactivation of the motor. Secondly, the magnet and magnetic field detector can be utilized to determine whether the chain has been cut, as cutting the chain will release the tension in the chain which maintains the magnet adjacent to the magnetic field detector. Accordingly, cutting the chain causes the magnet to fall away from the magnetic field detector so as to be capable of indicating a potential theft or trespass is being initiated.

The chain driven gate and security system of the present invention further includes an alarm for producing a visible or audible alarm. Various visible or audible alarms can be determined by those skilled in the art. For example, the alarm may include a high pitched siren and/or a flashing light which immediately indicate that the condition has occurred. Alternatively, the alarm might be simply a visual indication upon a computer screen or creation of a computer record identifying that an event has occurred.

A processor is provided which is connected to the gate operator's motor, sensor, and alarm. The processor controls the opening and closing of the gate. To this end, it is connected to switches, RF receivers or buttons so as to receive a signal so as to trigger the opening or closing of the gate. In addition, the processor is connected to the sensor so as to deactivate the motor when it has been sensed that the gate has completely opened or completely closed. Moreover, the processor is connected to the sensor which detects whether the chain has been severed. In the event that the chain has been severed, the processor activates the alarm. In the event that the chain has been severed, preferably the processor also deactivates operation of the motor since operation of the motor with a severed chain could cause damage to the entire system.

Accordingly, the security system for chain driven gates of the present invention is greatly improved compared to prior security systems.

Advantageously, the security system for chain driven gates activates an alarm in the event that the chain has been cut. In addition, the security system does not require substantial additional hardware and software.

Other features and advantages of the present invention will be appreciated by those skilled in the art upon reading the detailed description which follows with reference to the attached drawings.

DETAILED DESCRIPTION OF THE PREFERRED EMBODIMENTS

Figure 1:
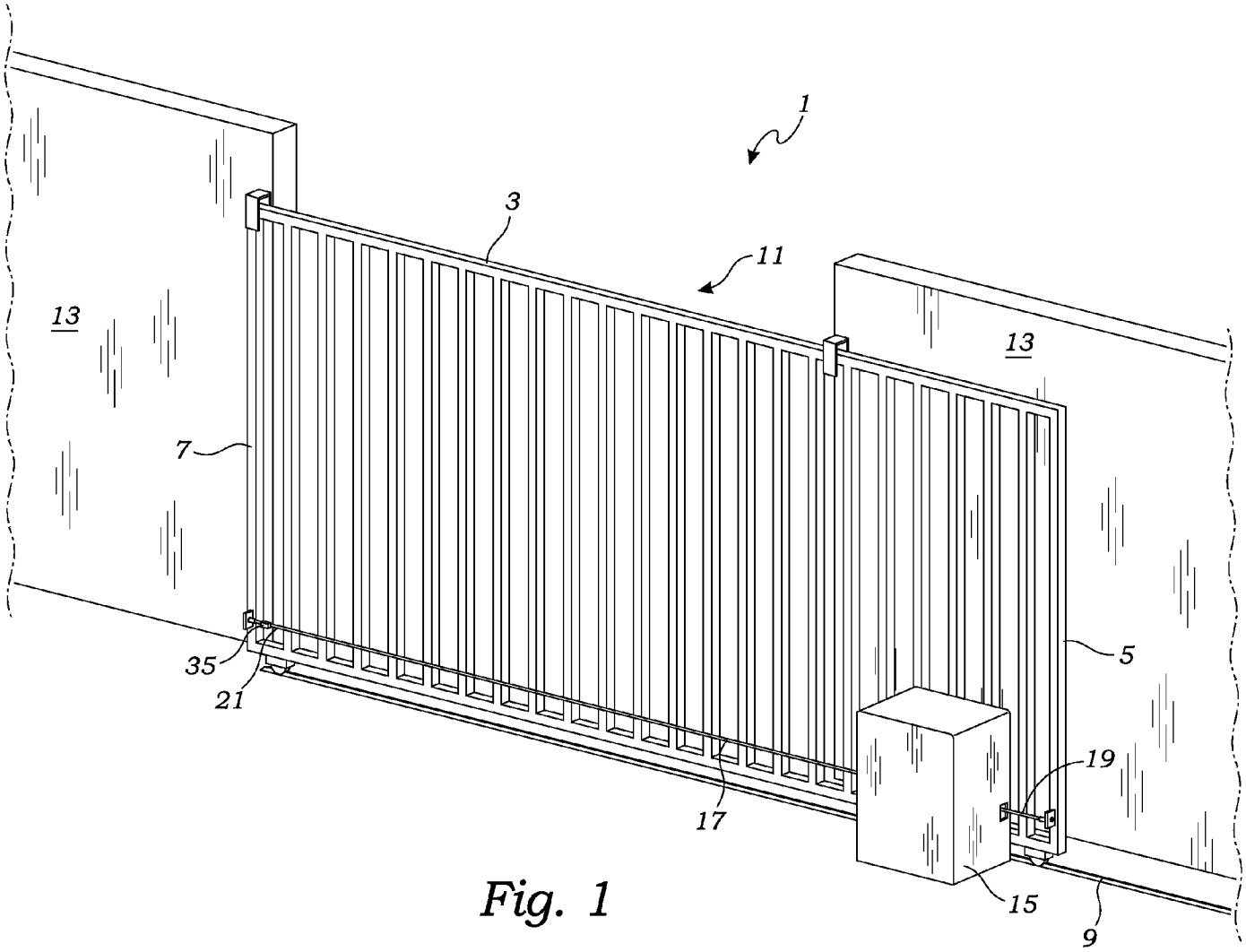
FIG. 1 is a perspective view illustrating a gate assembly of the present invention.
Figure 2:
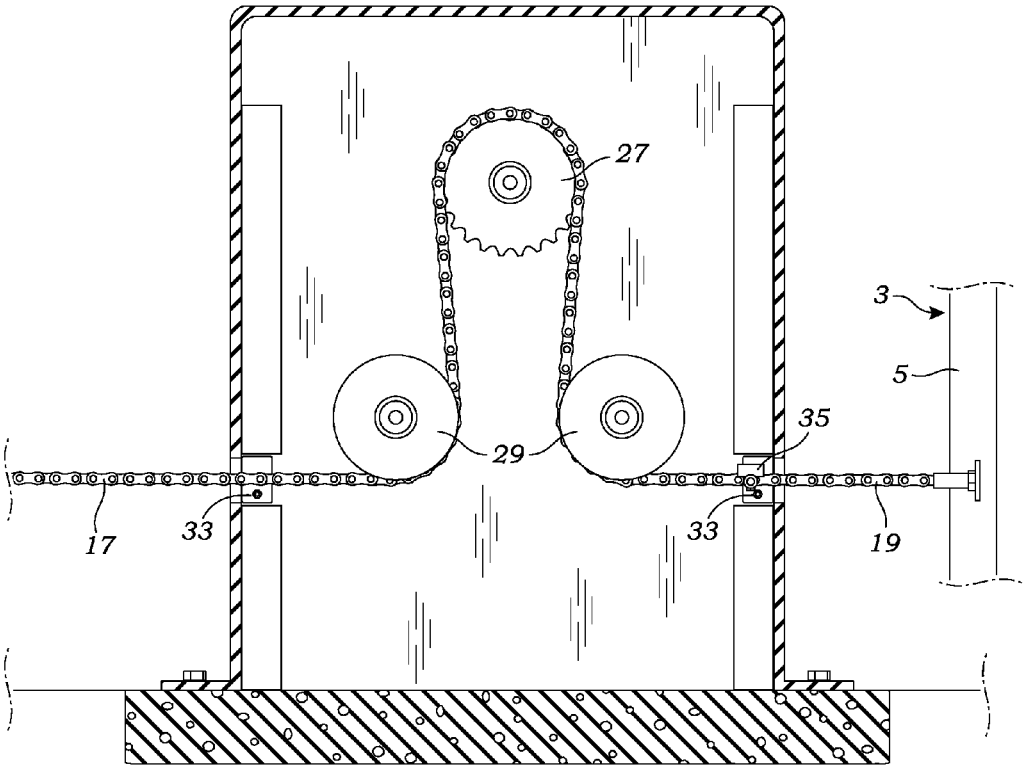
FIG. 2 is a side view illustrating the motor chain and a sensor for use with the gate and security system of the present invention.
Figure 3:
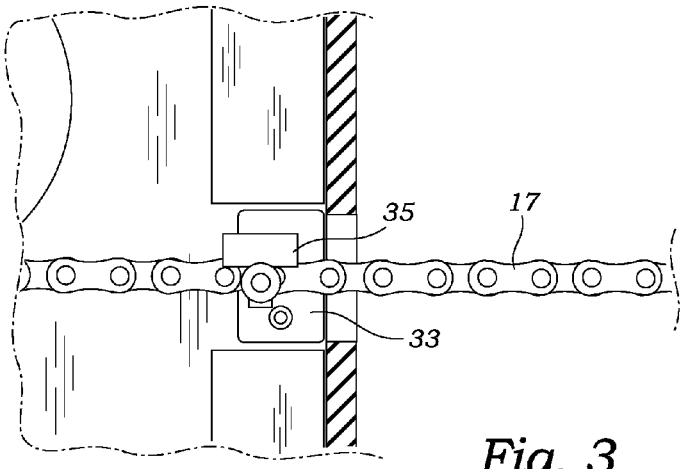
FIG. 3 is a side close-up view illustrating a chain and sensor for use with the gate and security system of the present invention.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

Figure 6:
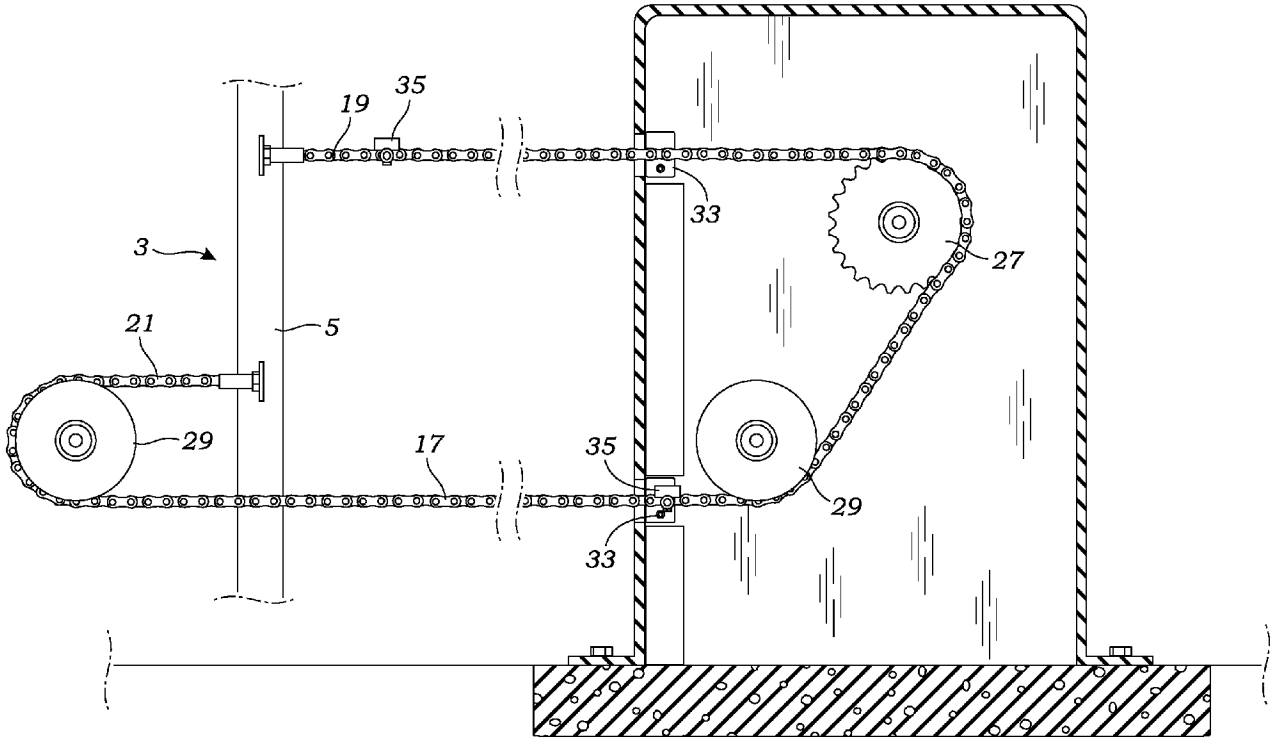
FIG. 6 is a side cut-away view illustrating the chain and sensor arrangement for opening the gate illustrated in FIG. 5.

With reference to FIGS. 1-8, the chain driven gate and security system 6 of the present invention includes a gate 3 and gate operator 15. As represented in FIGS. 1 and 6, the gate can be constructed in innumerable forms so as to block a portal 11 such as a driveway or a walkway. The gate 3 includes a first edge 5 and a second edge 7. Preferably a track 9 is provided upon which the gate slides. As reflected in the figures, the track 9 may be positioned below the gate. However, the track may also be positioned above the gate, such as where the gate includes rollers at the gate's top for rolling upon an overhead track (not shown).

The gate operator 15 controls the movement of the gate 3 so as to slide in a first direction so as to open the portal 11 or so as to slide the gate in a second direction so as to close the portal 11. For example, as illustrated in FIGS. 1 and 6, the movement of the gate 3 in a right direction causes the portal to open, while movement of the gate in the left direction causes the portal to close. The gate operator includes a chain 17 comprised of individual links. The chain 17 includes a first end 19 and a second end 21 which are both affixed to the gate. In a first embodiment illustrated in FIG. 1, the chain's first end 19 is affixed to the gate towards the gate's first edge 5 and the chain's second end 21 is affixed towards the gate's second edge 7. However, the gate 3 and security system of the present invention do not require this particular construction. For example, FIG. 6 illustrates an embodiment wherein both ends of the chain 17 are affixed toward the first edge 5 of the gate 3. Other gate and chain assemblies can be determined by those skilled in the art.

As illustrated in the figures, the chain operator 15 includes a motor 25 having a toothed sprocket 27 for engaging the links of the chain 17. Activation of the motor and the corresponding rotation of the toothed gear 27 causes the chain to be pulled so as to slide the gate in one direction or the other. Additional gears 29 may be provided to provide proper tensioning, orientation and alignment of the chain 17.

Figure 4:
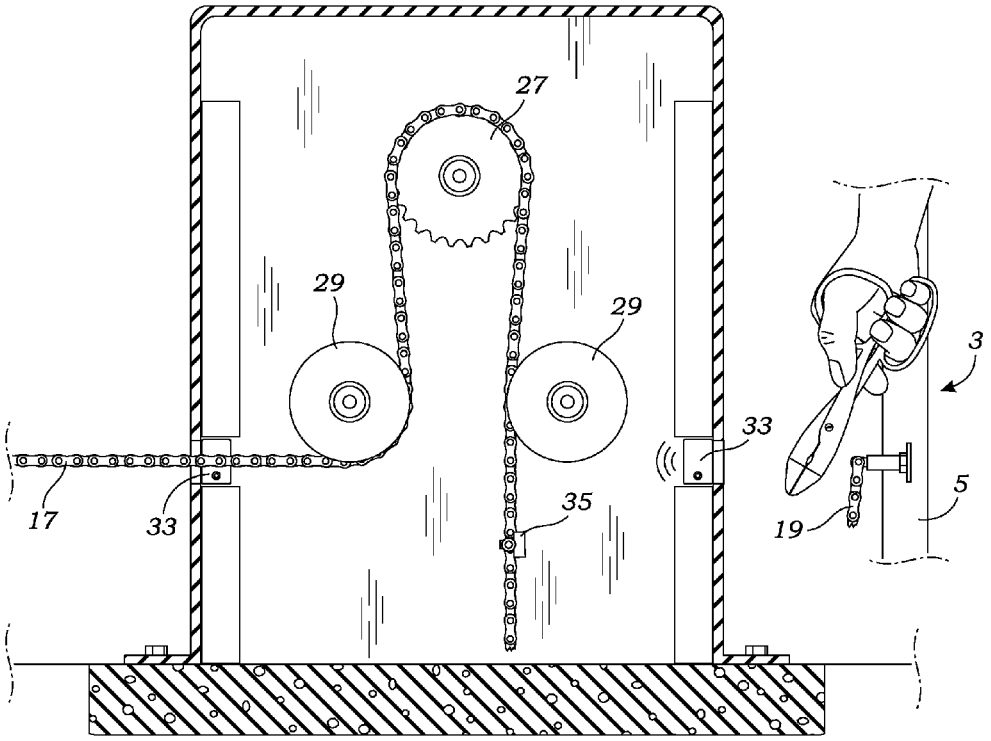
FIG. 4 is a side cut-away view illustrating a chain and sensor of the gate and security system of the present invention wherein the chain has been severed.
Figure 5:
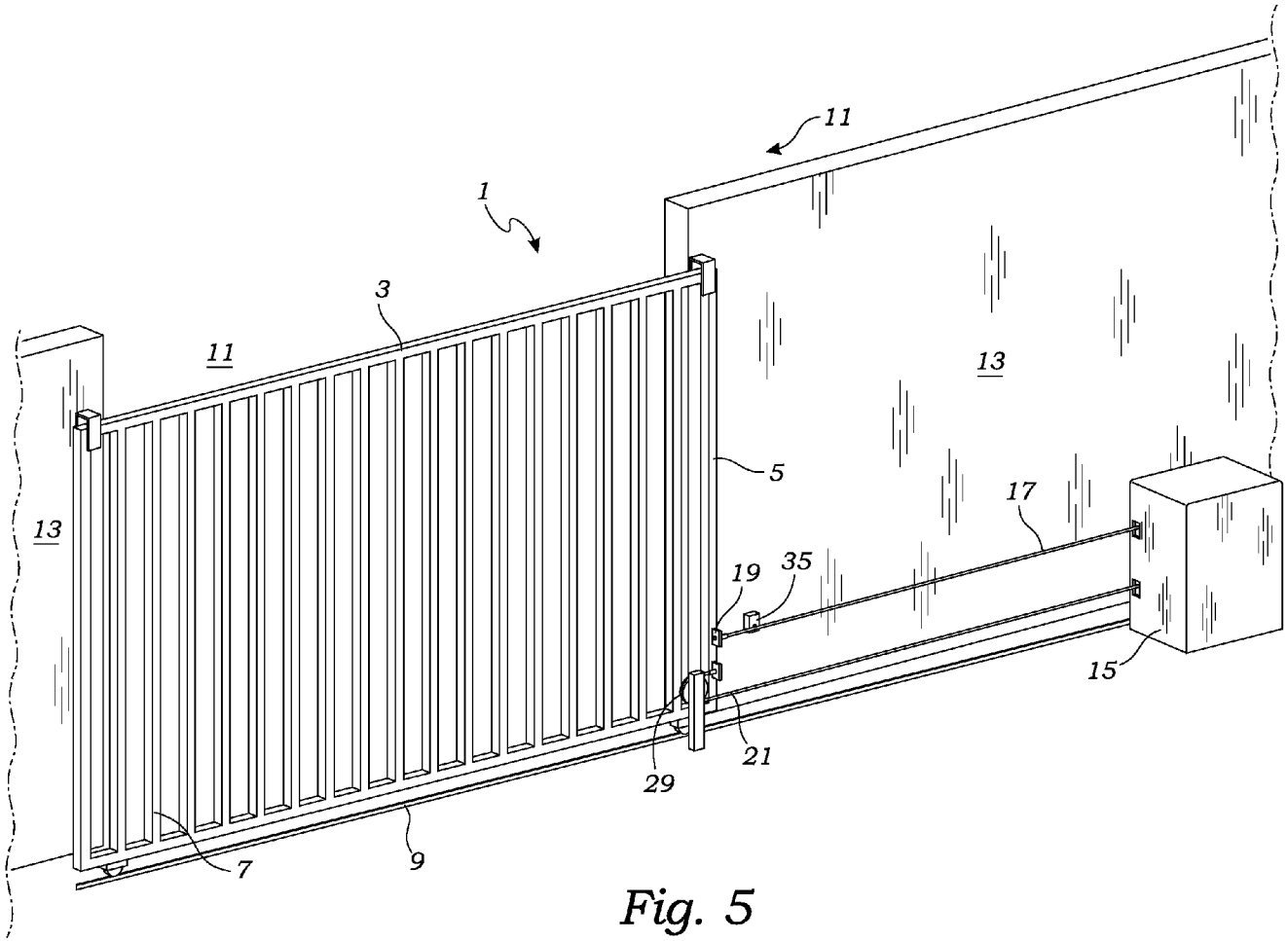
FIG. 5 is a perspective view of a second embodiment of a gate and gate operator for use with the gate and security system of the present invention.
Figure 7:
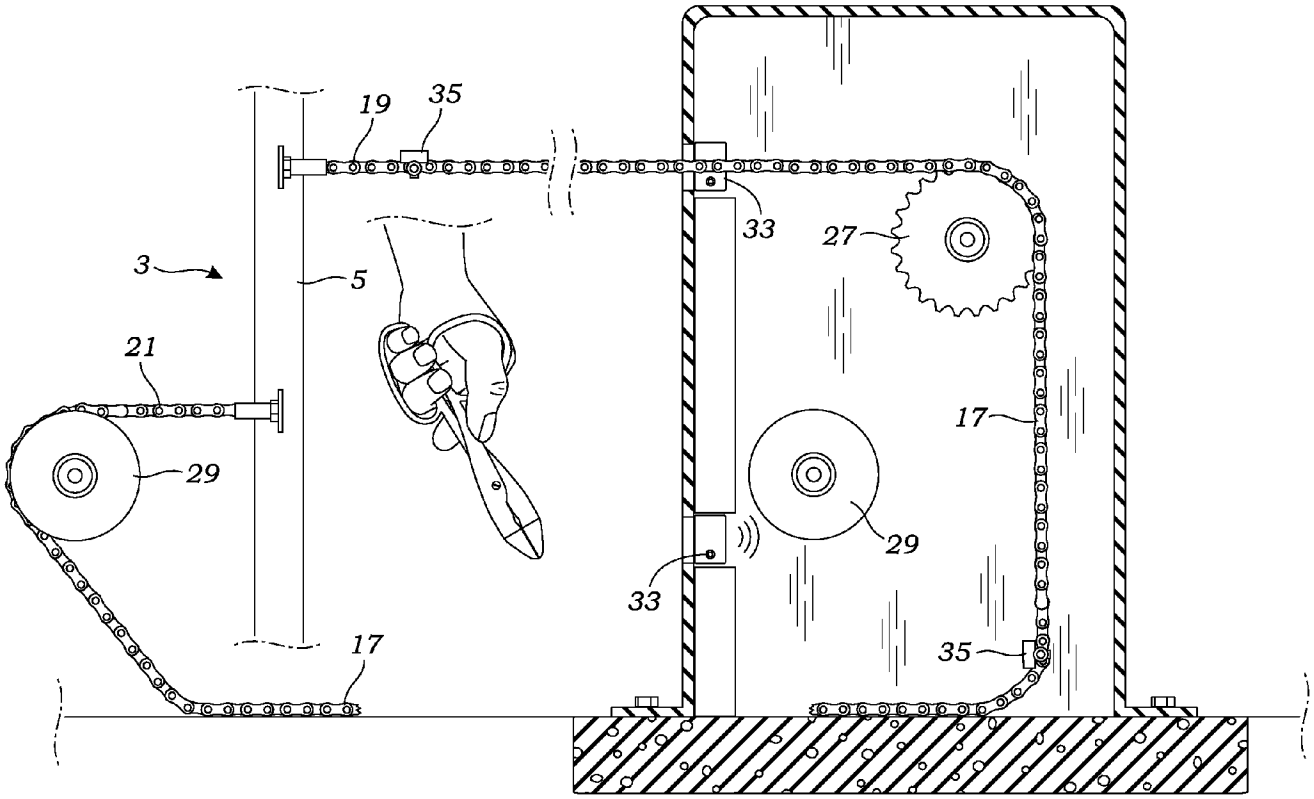
FIG. 7 is a second cut-away view illustrating the chain and sensor arrangement of FIGS. 5-7 wherein the chain has been severed.

The gate and security system 1 of the present invention includes a sensor 33 for determining whether the chain 17 has been severed, as illustrated in FIGS. 4 and 7. In a preferred embodiment, this sensor 33 includes a magnetic field detector for determining whether a magnet is adjacent. For this embodiment, a magnet 35 is affixed to the chain 17 and positioned so as to be adjacent to the magnetic field detector 33 when the gate 3 is in a closed condition. Preferably, a second magnet 35 is affixed to the chain 17 toward the chain's opposite end for being adjacent to a second magnetic field detector 33 when the gate is in an open condition.

Figure 8:
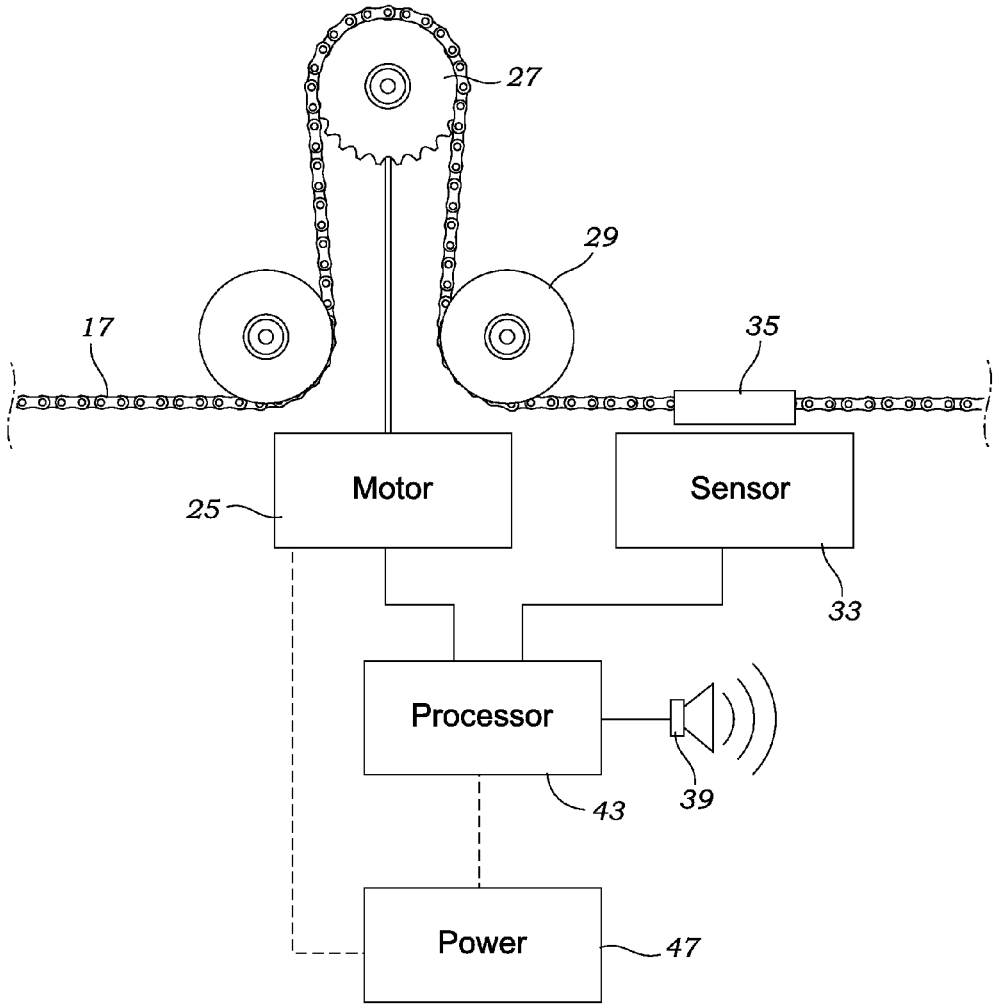
FIG. 8 is a block diagram illustrating the gate and security system of the present invention.

As illustrated in FIG. 8, the chain driven gate and security system 1 includes a processor 43 connected to the motor 25 and sensor 33. Moreover, the processor is connected to an alarm 39 which may be any hardware or software construction for indicating that the chain 17 has been severed. The preferred alarm 39 includes a speaker for sounding an audible alert and one or more light sources for providing a visual indication indicating that the chain has been severed. Moreover, the chain driven gate and security system includes a power supply 47 connected to the motor 25 and processor 43. The power supply 47 enables the motor 25 to be activated so as to rotate the sprocket 27. In addition, the power supply 47 provides power to the processor 43 for computer processing. The processor may be a general purpose computer or microprocessor including hardware and software as can be determined by those skilled in the art to provide automated or directed control of the opening and closing of the gate as well as activation of the alarm.

In operation, the processor 43 controls the well-known functions of the gate including its opening and closing such as by depressing a button or receiving a radio frequency signal such as transmitted by a handheld remote. The processor 43 activates the motor 25 so as to propel the gate to open or close until a magnet 35 moves to be adjacent to a sensor 33 which occurs when the gate comes to an open or closed condition. Once this occurs, this sensor 33 transmits a signal to the processor 43 which deactivates the motor 25 so as to lock the gate 3 in an open or closed condition.

In the event that the gate is in a closed condition, the processor maintains an "alarm" condition until the processor has been triggered to open the gate. While in the "alarm" condition, the magnet 35 will be maintained adjacent to sensor 33 unless the chain 17 has been severed. In the event that the chain 17 is severed, the magnet 35 will drop away from the sensor as illustrated in FIGS. 4 and 7. The movement of the magnet 35 away from the sensor 33 causes a signal to be sent to the processor 43. In the event that the processor indicates that the gate should be closed and the processor receives a signal from the sensor indicating that the magnet has dropped away from the sensor, the processor transmits a signal to the alarm 39 so as to provide a visual and/or audible indication that the gate's chain 17 has been severed. Preferably, the processor also prevents power from being transmitted to the motor 25 so as to maintain the motor in a deactivated condition.

While several particular forms of the invention have been illustrated and described, it will be apparent that various modifications can be made without departing from the spirit and scope of the invention. Therefore, it is not intended that the invention be limited except by the following claims.

Having described my invention in such terms so as to enable person skilled in the art to understand the invention, recreate the invention and practice it, and having presently identified the presently preferred embodiments thereof I claim:

1. A chain driven gate and security system comprising:

a gate for selectively blocking a portal, said gate having a first edge and a second edge and slideable in a first direction and a second direction between said gate being in an open condition and a closed condition;

a length of chain having a first end and a second end, said chain's first end affixed to said gate and said chain's second end affixed to said gate;

a motor with a rotatable sprocket which engages said chain, wherein activation of said motor rotates said sprocket to cause said chain to pull and slide said gate in either the first direction or the second direction so as to move said gate to an open condition or closed condition;

a sensor for detecting whether said chain has been severed, said sensor includes a magnet affixed to said chain and a magnetic field detector which senses that said magnet is adjacent or not adjacent to said detector, said magnet being adjacent to said magnetic field detector when said gate is in a closed condition and said magnet moving to a position not adjacent to said magnetic field detector in the event that said chain has been severed;

an alarm for producing a visible or audible alarm; and a processor connected to said motor, said sensor and said alarm, said processor activates said motor to open or close said gate upon receiving one or more predetermined signals, wherein said processor activates said alarm in the event that said processor detects that said chain has been severed by determining said gate should be in a closed condition but that said magnetic field detector does not sense said magnet being adjacent to said magnetic field detector.

2. A chain driven gate and security system of claim 1 wherein said processor deactivates operation of said motor in the event that said sensor detects said chain has been severed.

* * * * *